US006420051B1

(12) United States Patent
Appel et al.

(10) Patent No.: US 6,420,051 B1
(45) Date of Patent: Jul. 16, 2002

(54) DEVICE FOR ENCAPSULATING BLANKS OF HIGH TEMPERATURE METALLIC ALLOYS

(75) Inventors: Fritz Appel, Geesthacht; Uwe Lorenz, Bardowick; Michael Oehrling, Geesthacht; Richard Wagner, Reinbek, all of (DE)

(73) Assignee: GKSS-Forschungszentrum Gaesthacht GmbH, Gaesthacht (DE)

( * ) Notice: Subject to any disclaimer, the term of this patent is extended or adjusted under 35 U.S.C. 154(b) by 0 days.

(21) Appl. No.: 09/557,584

(22) Filed: Apr. 22, 2000

Related U.S. Application Data

(63) Continuation-in-part of application No. PCT/DE98/02369, filed on Aug. 17, 1998.

(30) Foreign Application Priority Data

Oct. 25, 1997 (DE) ..... 197 47 257

(51) Int. Cl.[7] ..... B21C 29/02; B32B 3/30

(52) U.S. Cl. ..... 428/577; 428/600; 428/660

(58) Field of Search ..... 266/255, 262; 432/254.1; 428/577, 587, 660, 600

(56) References Cited

U.S. PATENT DOCUMENTS 1,398,520 A * 11/1921 Howgate ..... 266/255
1,684,391 A * 9/1928 Green ..... 266/255
2,091,666 A * 8/1937 Watrous ..... 263/49
2,102,019 A * 12/1937 Miller ..... 263/49
2,199,321 A * 4/1940 Ostendorf ..... 29/189
2,861,327 A * 11/1958 Bechtold et al. ..... 29/198
3,067,073 A * 12/1962 Neuhauser et al. ..... 148/13
3,130,089 A * 4/1964 Mellinger ..... 148/13
3,164,884 A * 1/1965 Noble et al. ..... 29/19
3,777,362 A * 12/1973 Nilsson et al. ..... 29/474.3
4,147,506 A * 4/1979 Southern et al. ..... 432/148
4,831,708 A * 5/1989 Yoshiwara et al. ..... 29/423
4,966,816 A * 10/1990 Wardlaw et al. ..... 428/552
5,144,825 A * 9/1992 Burg et al. ..... 29/889.7
5,417,567 A * 5/1995 Peter ..... 432/205

FOREIGN PATENT DOCUMENTS

EP 124708 * 11/1984

* cited by examiner

*Primary Examiner*—John J. Zimmerman
(74) *Attorney, Agent, or Firm*—Klaus J. Bach

(57) ABSTRACT

In a device for encapsulating blanks of metallic high temperature alloys, particularly TiAL alloys, which are subjected to forging or rolling for hot forming, at least a first inner envelope is supported on the blank in closely spaced relationship therefrom and a second envelope surrounds the first envelope and both envelopes consist of a metallic material.

16 Claims, 5 Drawing Sheets

DEVICE FOR ENCAPSULATING BLANKS OF HIGH TEMPERATURE METALLIC ALLOYS

This is a continuation-in-part application of international application PCT/DE98/02369 filed Aug. 17, 1998 and claiming the priority of German application 197 47 257.5 filed Oct. 25, 1997.

BACKGROUND OF THE INVENTION

The invention relates to a device for encapsulating blanks of high-temperature metallic alloys, especially TiAl alloys, which are subjected to a forging or rolling process for hot forming.

Metallic, high-temperature alloys are used for the manufacture of highly strained or highly stressed components such as turbine components for use in airplane propulsion turbines. In order to achieve the desired properties, such as high strength, it is for certain components basically necessary that they have been hot-formed. In the case of TiAl alloys as the metallic high temperature alloy, hot forming of the components is necessary also with regard to obtaining a certain grain structure which could not be achieved in any other way, that is, by melt metallurgy. It has been found that the hot forming of TiAl casting blocks requires temperatures of 1100° C., see Y. -W. Kim, D. M. Dimiduk, J. Metals 43 (1991) 40. This however is possible only in a non-isotherm manner, for example during forging or rolling, because of the temperature limits provided by the mold or receiver structures. Since the malleability and form resistance of TiAl alloys are highly temperature dependent, the blanks need to be encapsulated for the forging or rolling procedure in order to avoid high temperature losses. As encapsulating materials, Ti-alloys or austenitic steels are available whose form-change resistance however is, at the required temperatures, very much smaller than that of TiAl blanks or respectively, an unfinished body consisting of that material. The use of encapsulating materials with a better adapted forming resistance such T2M-molydenum is not reasonable for cost reasons.

The large differences in the forming resistances of the encapsulating and the core materials leads during forging or rolling to non-uniform shaping with undesirable variations in the degree of the shape over the length of the strand and furthermore to the formation of cracks in the capsules. It has been tried to adapt the forming resistances between the capsule and core materials to one another by providing a cooling phase between the heating and the strand pressing steps. Computer models of the temperature curve of capsule and core with an increasing pause show that the temperature differences achieved in this way are too small.

Also, with a low assumed heat transfer value as it can be achieved only with a heat insulation layer (for example, glass wool), the temperature difference achievable is still not sufficient.

It is therefore the object of the present invention to provide a device for encapsulating blanks of metallic high-temperature alloys, whereby heat losses of the blank are avoided. In accordance with the object, the encapsulation is cooled by increased waiting periods between the heating and the forging or rolling procedure at low temperature losses in the core to such a degree that the encapsulation material and the core material have almost the same forming resistance for which temperature differences of up to 500° C. are necessary. The device should be simple and inexpensive.

SUMMARY OF THE INVENTION

In a device for encapsulating blanks of metallic high temperature alloys, particularly TiAL alloys, which are subjected to forging or rolling for not forming, at least a first inner envelope surrounds the blank in closely spaced relationship and a second envelope surrounds the first envelope and both envelopes consist of a metallic material.

With such a device, heat radiation out of the blank, that is out of the core of the arrangement, is minimized. At the given temperatures, the heat radiation is the largest cause for the heat losses. It is possible furthermore to provide for minimal heat conductivity by vacuum insulation, whereby also heat transfer by convection is avoided. Also, material combinations are avoided. With this type of forging or rolling at the required high temperatures, undesired reactions would otherwise occur.

It has been found that, in order to form an effective radiation shield for the inner envelope, a sheet metal structure is sufficient to reduce the heat energy radiated off the blank by 33%.

The outer envelope of the device should preferably have a wall thickness of 5 to 10 mm as tests have shown. Basically, the outer envelope consists of steel or preferably of a titanium alloy such as TiAl6V4.

Tests have further shown that the inner envelope should preferably have a wall thickness of only 0.1 to 1 mm. A wall thickness of 0.3 mm was found to be particularly advantageous in order to achieve a reduction of the heat radiation by 33%. Because of the high heating and working temperature on one hand and because of costs on the other, the inner envelope preferably consists of foils of molybdenum and/or tantalum, which have low heat emission characteristics. In this way also, material combinations are avoided which would lead to undesired reactions at the high temperatures required.

In principle, it is possible in different ways, to ensure that there is always a gap between the blank and the surrounding envelope in order to avoid heat contact between the blank and the inner envelope. But it has been found to be advantageous to shape the blank such that it has a plurality of projecting webs which act as spacing members between the blank and the surrounding envelope. If the blank is essentially cylindrical, the webs can be formed in a simple manner by turning or cutting.

In order to make sure in the same manner as described earlier that the inner envelope is only in a negligible heat contact with the outer envelope, the outer envelope may have a plurality of inwardly projecting webs which are directed toward the inner envelope and which act as spacers for the inner envelope. Also, these webs may, in principle, be formed by turning or suitably cutting them from the outer envelope particularly if the outer envelope has a hollow cylindrical shape. The webs of the outer envelope and of the inner blank or the core are preferably so formed that their contact areas with the adjacent inner envelope is small relative to the rest of the outer surface area.

As already mentioned, a single inner envelope serving as a radiation shield may reduce the heat radiation by 33%. In order to further reduce the heat radiation from the blank, a third and a fourth envelope may be disposed between the first and the second envelope in closely spaced relationship. The selection of additional envelopes depends on whether it is considered necessary to provide the same forming resistance for the envelope and the core material for a particular forging or rolling procedure dependent on the material forming the blank.

As with the basic arrangement as described above, wherein at least two envelopes are provided, it may also be advantageous for an arrangement with four envelopes to provide the third envelope adjacent the first inner envelope with a plurality of webs projecting toward the first and the fourth envelope so as to form spacers with respect to the first and fourth envelope. Also in this case, the webs can be formed by turning or cutting of the third envelope. The blank and the outer envelope would still be turned or cut to form the webs thereon as described earlier.

Preferably, the third envelope consists of the same material as the second envelope and preferably the fourth envelope consists of the same material as the first envelope.

Altogether, with a device made in this way with four envelopes, the energy radiated from this blank is reduced to 25%.

Finally, for a device with two envelopes or more envelopes, the outer envelope must be vacuum tight so that heat transfer through the gas in the spaces between the envelopes as well as heat transfer by convection of gases in the spaces between the envelopes is suppressed. Furthermore, an oxidation of the metallic parts is prevented in order to maintain the low emission capabilities of these parts.

The invention will be described below with reference to the accompanying schematic drawings and graphic representations on the basis of a particular embodiment and some modifications thereof.

DESCRIPTION OF PREFERRED EMBODIMENTS

Figure 1:
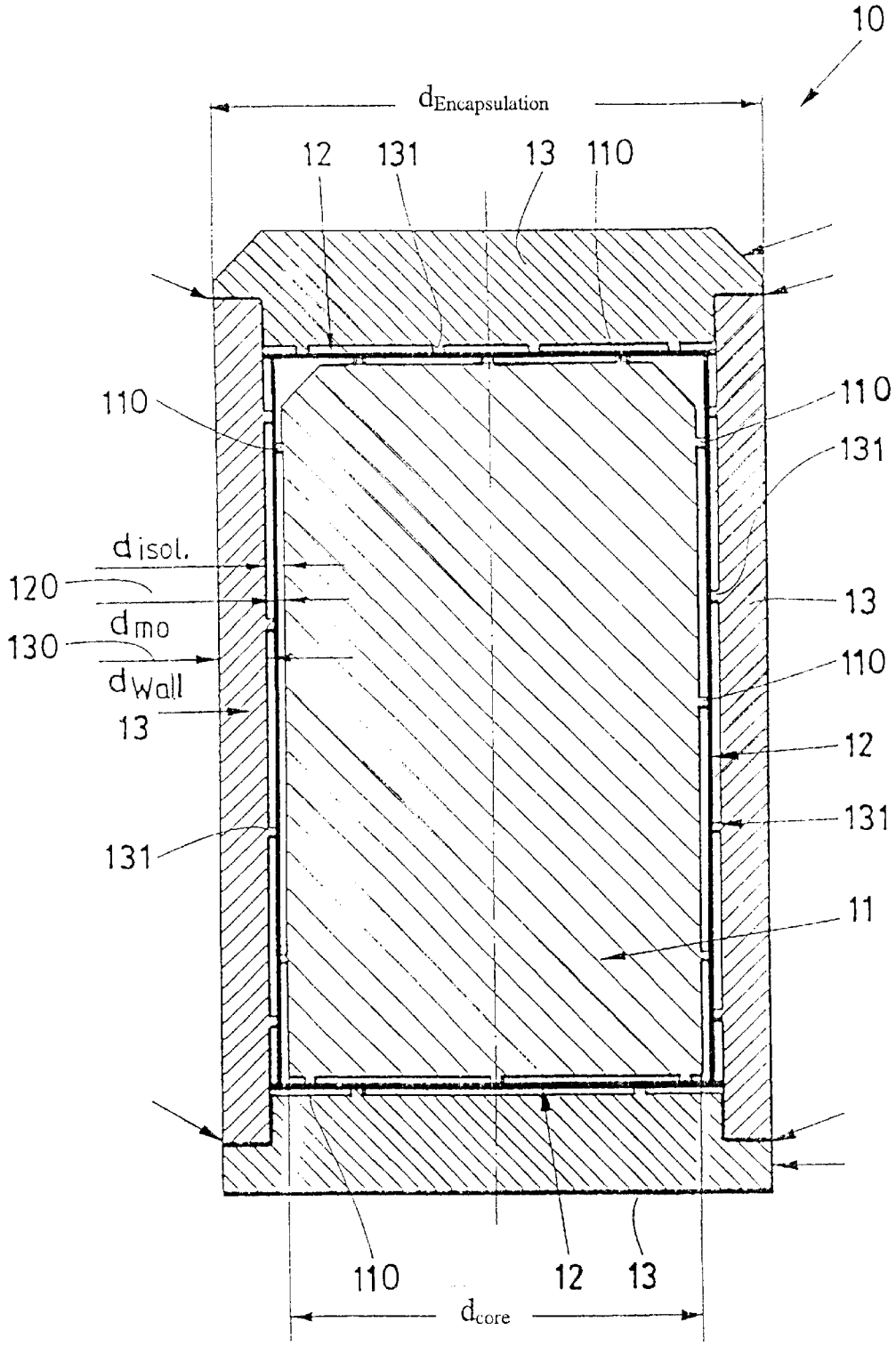
FIG. 1 shows, in a cross-sectional view, a device according to the invention, which includes two envelopes surrounding a blank consisting of a metallic high temperature alloy.
Figure 2:
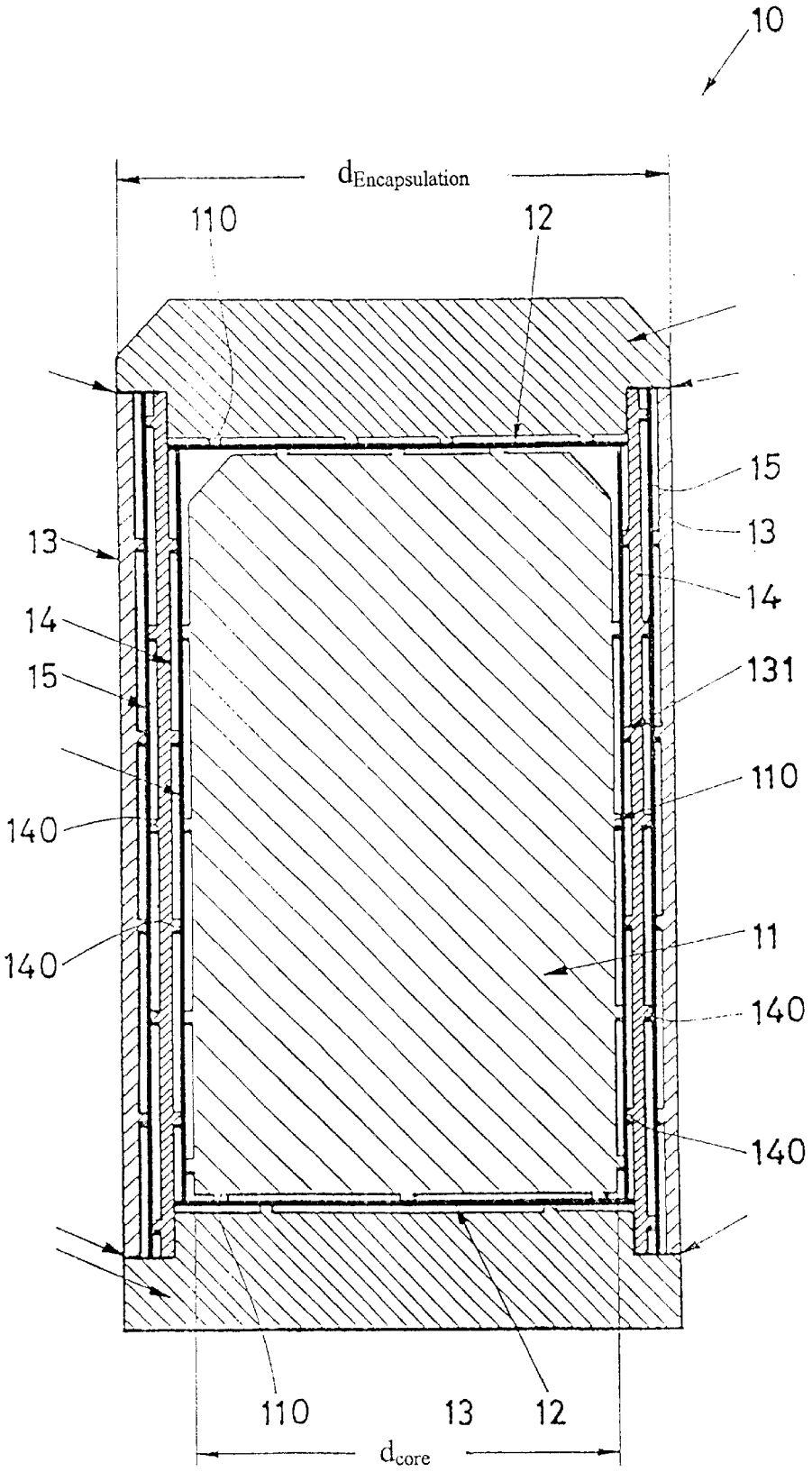
FIG. 2 shows an embodiment of the device of FIG. 1, wherein, at least in partial areas, the blank consists of a metallic high temperature alloy and is surrounded by four envelopes.
Figure 3:
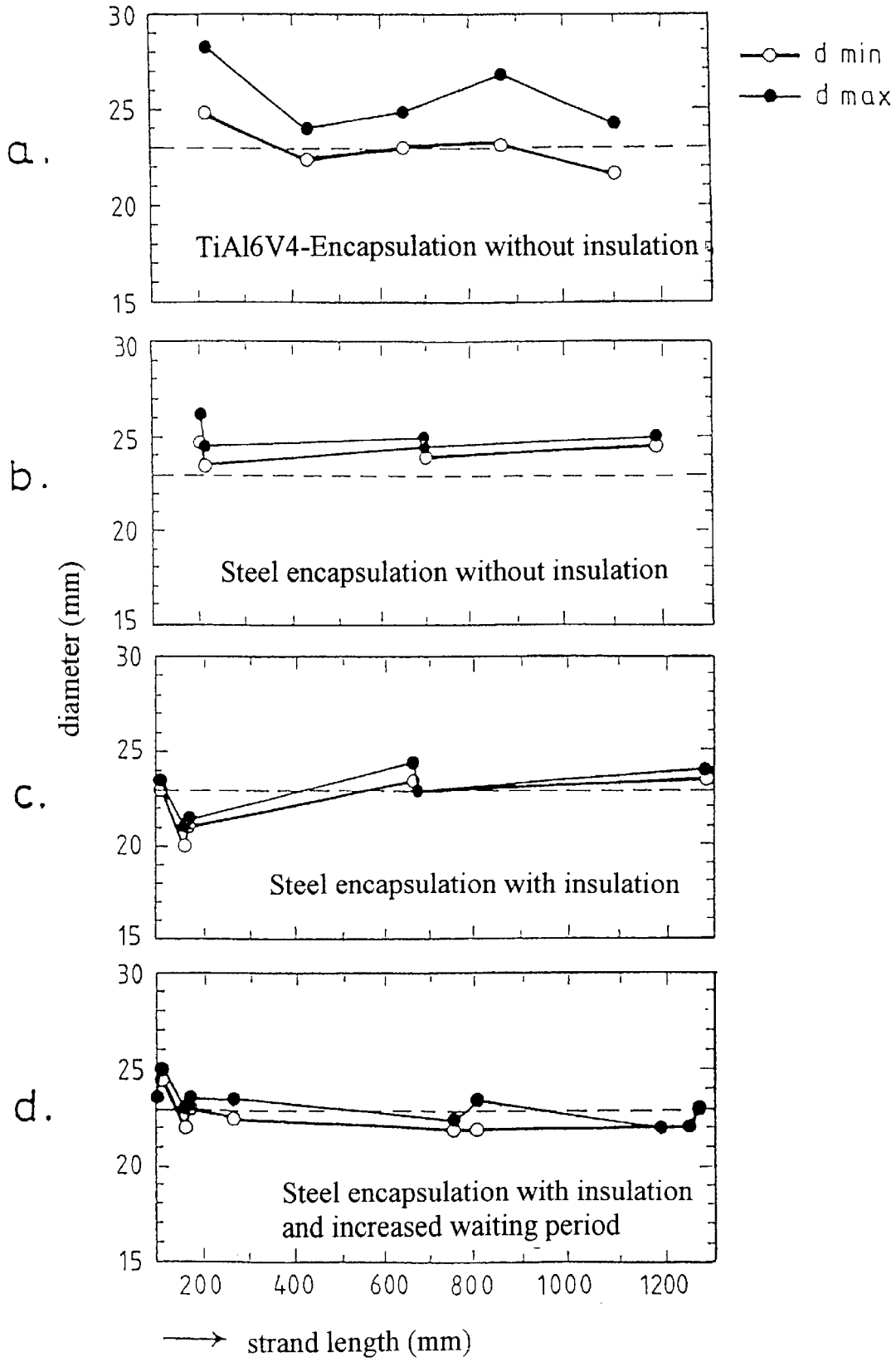
FIG. 3*a* to FIG. 3*d* show the minimum and the maximum diameters of the cross-section of the core (blank) in the device over the strand length for various shapes of the encapsulation and waiting periods after heat up.

FIGS. 1 and 2 show a device 10 according to the invention, wherein the blank 11, which is to be subjected to forging or rolling and which consists of a metallic high temperature alloy, particularly a TiAl alloy, has an essentially cylindrical shape. Consequently, also the device 10 is essentially cylindrical. It is pointed out however, that the blank and the device are not necessarily cylindrical since the blank 11 may have many other shapes adapted roughly to the final shape of the product already before the final forging or rolling.

The description of the invention however is based on the representations of the device 10 according to FIGS. 1 and 2, where an essential circular cross-section is shown. The design principles for the device 10 are generally the same for any shape.

The device 10 encloses a blank 11 surrounded by a first inner envelope 12 and a second outer envelope 13 as shown in FIG. 1. The enclosure of the blank 11 in the device 10 according to FIG. 1 is complete that is not only the outer, in this case cylindrical, surface of the blank 11 is surrounded by the envelopes 12,13, but also the respective flat end surfaces of the blank 11.

The first inner envelope 12 closely surrounds the blank 11, but in spaced relationship therefrom wherein the inner envelope 12 has a wall thickness of for example 0.1 to 1 mm, preferably 0.3 mm. The inner envelope which comprises sheet metal preferably consists of tantalum or molybdenum. Basically, however, any other suitable material with a low heat emission coefficient $\epsilon$ can be used as long as it does not react with the material of which the blank 11 or the outer envelope 18 consists.

The second outer envelope 13 has a much larger wall thickness than the inner envelope 12. Its thickness is for example in the range of 5 to 10 mm. The inner envelope 12 and the outer envelope 13 both extend also over the essentially flat end faces of the blank 11 and are of the same design as described earlier.

The outer envelope 13 may consist for example of steel or any other material suitable for the purpose such as TiAl6V4.

The blank 11 includes a plurality of projecting webs 110 which act as spacers for the inner envelope surrounding the blank 11. The webs may be formed for example by downcutting or turning of the blank 11 by for example 0.3 mm such that the webs formed in this way have a height of 0.3 mm and a width of about 1 mm. In this way, the required small distances $d=d_{isol}-d_{mo}$ between the first envelope 12, which serves as a radiation protection sheet metal and the blank 12 can be maintained. For suppressing direct heat transfer between the blank 11 and the second outer envelope 13, which encloses the first inner envelope 12, the webs 110 on the blank 11 and the webs 131, which are formed in a similar way on the second outer envelope 13, are displaced with respect to each other. Altogether, the complete enveloping structure comprising the first envelope 12 and the second envelope 13 form a double radiation protection shield whereby the heat energy radiated off the blank 11 is reduced to about one third.

In the embodiment of the device 10 according to FIG. 2, which basically is of the same design as the device according to FIG. 1, an additional third envelope 14 and a fourth envelope 15 are provided. Those envelopes 14, 15 are also arranged in closely spaced relationship. In this case, the third envelope 14, which is disposed adjacent the first inner envelope 12, includes a plurality of webs directed toward the first envelope 12 and also toward the fourth envelope 15. The webs 140 also serve as spacers for the adjacent envelope 12 and also the adjacent fourth envelope 15. The third envelope 14 may consist of the same material as the second envelope 12. In the embodiment of the device 10 according to FIG. 2, practically four radiation protecting metal sheets are effective, that is, the first envelope 14, the second envelope 13, the third envelope 14 and the fourth envelope 15.

In the embodiment of the device 10 according to FIG. 2, the heat energy radiated off the blank 11 can be reduced in comparison to an unprotected blank 11 to about 25%. For an estimation of this reduction of the radiation heat energy a calculation is presented later.

In the temperature range of 1000° to 1400° C., basically steel or titanium alloys can be used as the material for the envelopes 13 and 14. At higher temperatures, refractory metals such as Mo or Ta should be used for these envelopes 13 and 14. The envelopes 12 and 15 consist preferably of Mo or Ta even at temperatures exceeding 1400° C. Basically, however, other suitable materials with low emission coefficients $\epsilon$ can be used if material combinations which could lead to reactions are avoided. The first envelope 12 and the fourth envelope 15 are preferably thin-walled. It is pointed out that the device according to the invention is not only limited to the forging or rolling of titanium aluminides, but rather can of course also be used successfully for forming by forging or rolling at temperatures above 1000° C. in connection with other metallic high temperature alloys.

In the devices according to FIGS. 1 and 2, at least the first envelope 12 encloses the blank 11 in a vacuum-tight manner. The necessary evacuation of the intermediate spaces between at least the first envelope 12 and the blank 11 is achieved by welding the cover and the bottom of the first envelope 12 to the cylindrical portion in a vacuum chamber by electron beam welding. Altogether, the device can be manufactured in this manner at relatively low costs. Also the other envelopes 13 to 15 of the device may be vacuum-tight if this is desired.

An approximation for determining the effectiveness of the design according to the invention for the device 10 regarding the avoidance of heat losses by radiation will be presented on the basis of the radiation emission of blanks 11, which are not insulated by heat radiation shields.

In accordance with the Stefan-Boltzmann law, a non-black body emits in a cold space the heat energy:

$$DQ_s/dt=F\epsilon cT^4,$$

Wherein:

F=the surface area of the body c=Stefan Boltzmann radiation constant ($c=5.7\times10^{-8}$ $Wm^{-2}$ $W^{-4}$)

$\epsilon$=heat emission capability of the body

T=absolute temperature

For bare metallic bodies, often $\epsilon=0.3$. Consequently, an extrusion blank with the dimensions of a diameter of 65 mm and a length of 170 mm heated to 1300° C. would, upon removal from the furnace without insulation, radiates off a heat energy of initially $DQ_s/dt=4.6$ kW.

The heat losses generated thereby can be effectively minimized at these temperatures by providing one or more radiation protection shields (envelopes), which are disposed between the hot body or, respectively, blank 11 and the cold ambient. For the present geometry of a hot cylindrical blank 11, the heat energy radiated off the hot cylindrical blank 11 is reduced, with a radiation shield disposed concentrically around the body, to $$Q_{s,1}=dQ_{s,1}/dt=F\epsilon c\ T^4/(\epsilon_s/\epsilon_e+r_{k/rs}) \quad \text{(Eq. 2)}$$

$$\text{With } \epsilon_e=\epsilon\epsilon_s/(1-(1-\epsilon_s)(1-\epsilon F_k/F_s))$$

Wherein:

$\epsilon_s$=emission capability $r_k$=radius of the hot body $r_s$=radius of the radiation protection shield In accordance with Eq. 2:

$$DO_{s,1}/dr_k>0 \quad \text{(Eq. 3)}$$

that is, the effectiveness of the radiation shield is higher the smaller its distance from the hot body is. If for simplification of the estimation, it is further assumed that $\epsilon=\epsilon_s$ and $r_k=r_s$, then $$dQ_{s,1}/dt=\tfrac{1}{2}dQ_s/dt \quad \text{(Eq. 4)}$$

With the provision of one radiation protection shield, the heat energy radiated off is already reduced to 50%. With the use of n radiation protection shields, under the same simplifying conditions, the following applies:

$$dQ_{s,n}/dt=(1/(n+1))dQ_s/dt \quad \text{(Eq. 5)}$$

Under the conditions represented here, the encapsulation to avoid heat losses by way of radiation must occur according to the following principles:

In accordance with Eq. 2, materials with low emission capability $\epsilon$ must be used for the radiation protection shields (envelopes). Because of the high temperature and for cost reasons, the selection of materials is limited to metal sheets, or respectively, foils of Mo or Ta. However, these materials should have smooth surfaces free of any oxides.

The distance between the hot body and the first radiation protection shield and between any additional radiation shields should, in accordance with Eq. 2 be as small as possible.

Heat losses by convection or heat conduction should be avoided.

For the testing of the form pressing capsule design, four rolling tests were performed. For this purpose blanks 11 with a diameter of 65 mm which consisted of the same TiAl alloy were encapsulated in different ways. Since, with the encapsulation design as described earlier, the desired temperature difference between the encapsulation and the blank 11 increases with an increased waiting period between heating and forging or rolling, also the waiting period was varied. All the other test conditions (heat-up temperature 1250° C., the predetermined stamp speed 20 mm/s) as well as the outer dimensions of the encapsulation were the same in all tests. Specifically, the following encapsulation shapes and waiting periods were selected.

1. TiAl6V4—envelope without heat insulation, 25 s waiting period.
2. Steel envelope without heat insulation but with an Mo foil inserted as reaction barrier, 25 s waiting period.
3. Steel envelope without heat insulation as described in the description (see FIG. 1), 25 s waiting period.
4. Steel envelope with heat insulation as described in the description (see FIG. 1), 50 s waiting period.

Figure 4:
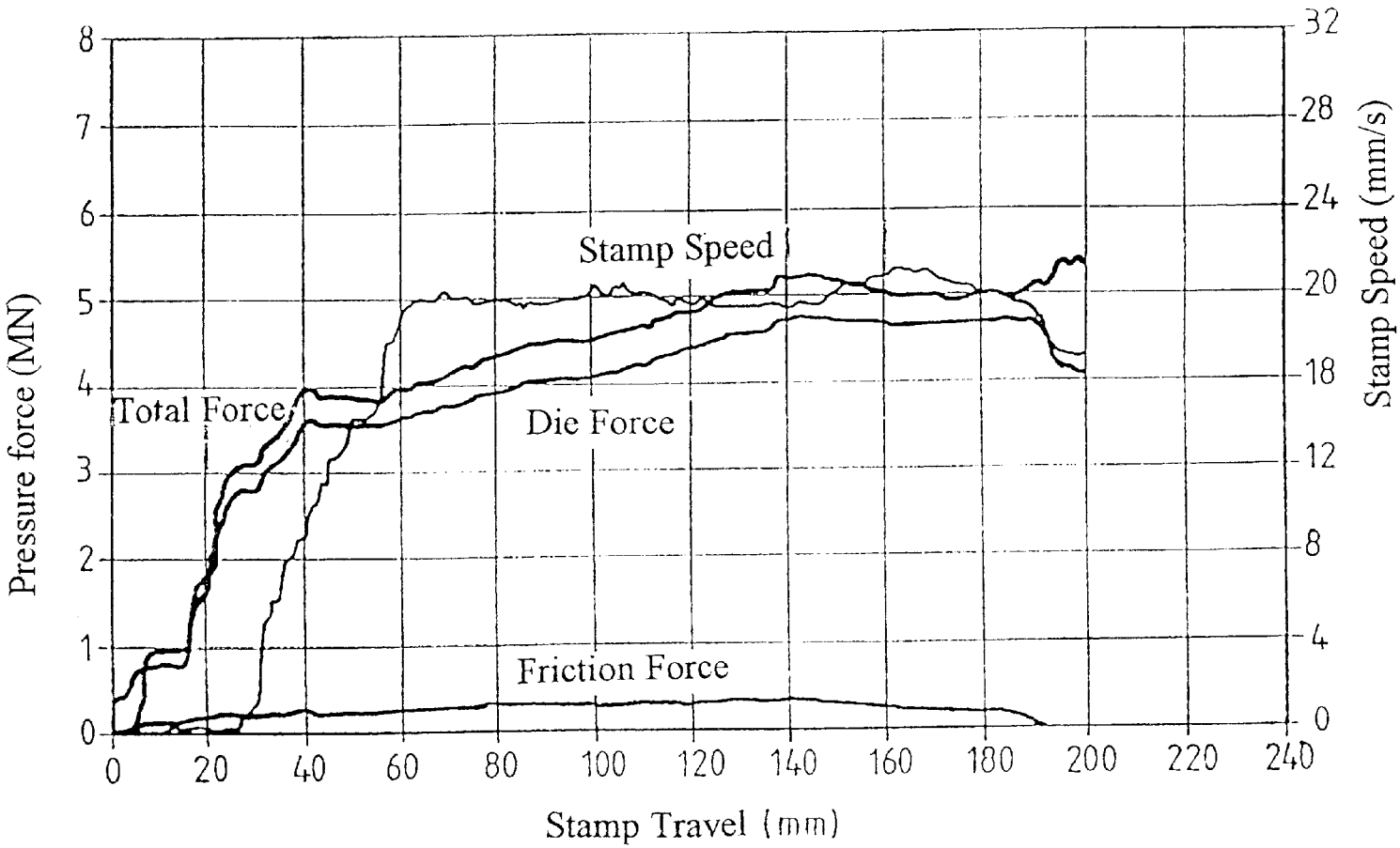
FIG. 4 shows the forces effective during forging or rolling in a steel encapsulation with heat insulation after a waiting period of 25 sec after heat up.
Figure 5:
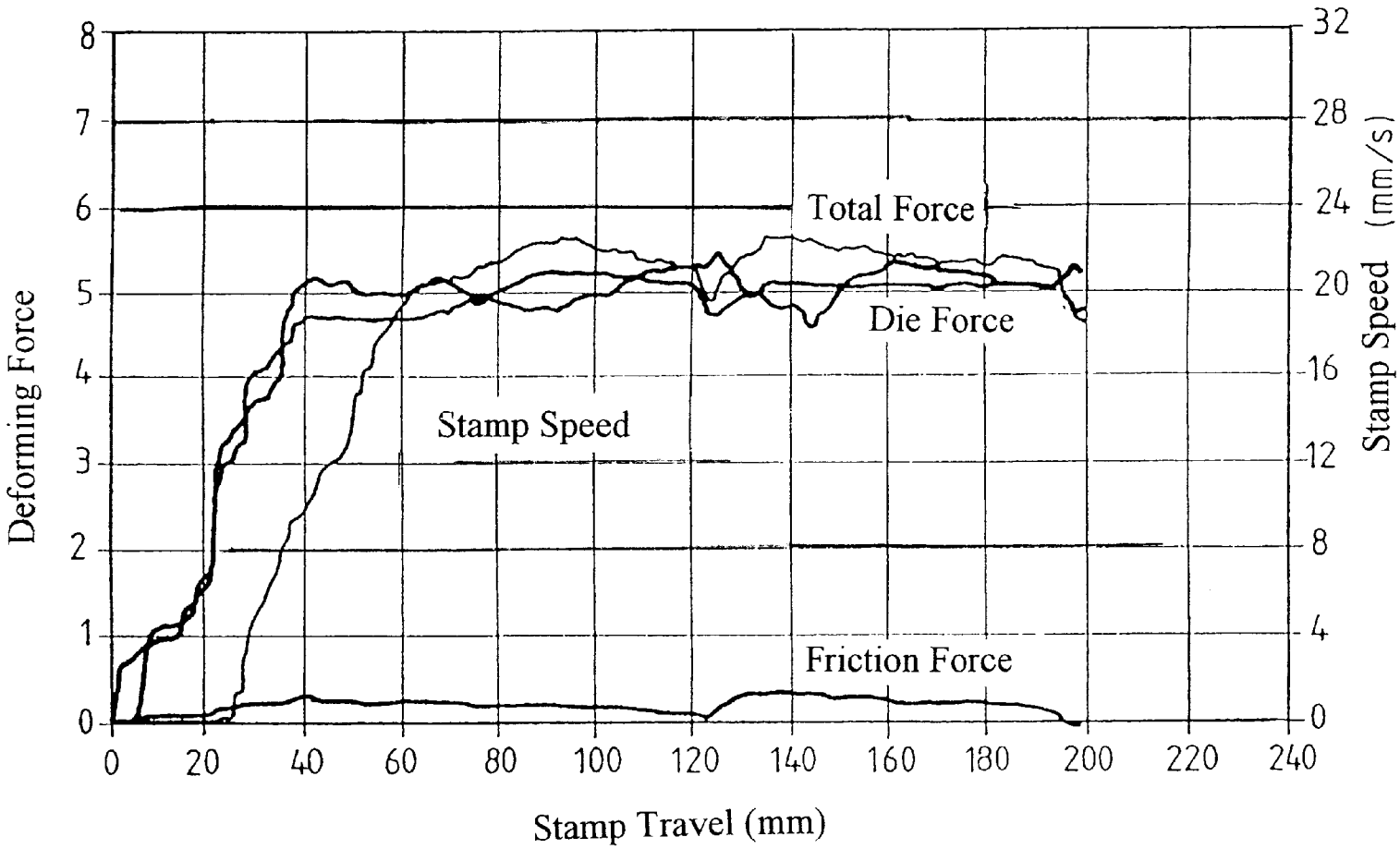
FIG. 5 shows the forces effective during forging or rolling in a steel encapsulation with heat insulation after a waiting period of 50 seconds after heat up.

After forging or rolling the strands were cut open and the cross-section of the TiAl blank over the length of the strand was examined. In the ideal case—that is when the envelope and the core material have the same forming resistance, the TiAL blank 10 should have a circular cross-section with a diameter of 22.9 mm with a selected receiver diameter of 85 mm and a mold diameter of 30 mm. FIGS. 3*a*–3*d* show the minimal and maximal diameters of the generally oval cross-section of the TiAl blank 10 after these tests. The test results show that for the TiAl6V4 envelope without heat insulation the most unfavorable conditions exist, that is the core cross-section has the largest differences between minimal ($d_{min}$) and maximal ($d_{max}$) diameter. Because of the small forming resistance of the TiAl6V4 alloy as compared to that of the core material, the core cross-section is partially substantially above the ideal value of 22.9 mm. In addition, the cross-section clearly varies over the strand length. In the case of steel encapsulation without heat insulation, the cross-section more nearly approximates the circular shape and the diameter over the length is more uniform. But the values are above the ideal value of 22.9 mm. The use of an encapsulation of steel with heat insulation leads to diameters of about 22.9 mm, wherein for an extended waiting period of 50 s, the most uniform pattern is obtained. From these results, it can be concluded that the heat insulation is effective and that, with waiting periods of 50 s, a good adaptation of the forming resistance between the steel enclosure and the TiAl blank 10 is achieved. The effectiveness of the heat insulation is also apparent from the force distribution during strand pressing. As shown in FIGS. 4 and 5, the initial molding force during pressing of encapsulations with heat insulation after a waiting period of 50 s is substantially higher than after a waiting period of 25 s because of the higher forming resistance resulting from the lower temperature with the use of an encapsulation with heat insulation. Furthermore, the fracturing of the strands in the initial working area does not occur which can also be explained by a better adaptation of the forming resistances of the encapsulation and the blank material. Consequently, the object to be achieved by the invention has been obtained.

What is claimed is:

1. A device for encapsulating a blank of metallic high temperature alloys, which are subjected to hot forming by rolling or forging, comprising at least a first inner envelope closely surrounding said blank, means projecting from one of said inner envelope and said blank for maintaining said first inner envelope in spaced relationship from said blank and a second outer envelope surrounding said first inner envelope in closely spaced relationship, said first and said second envelopes consisting of a metallic material.

2. A device according to claim 1, wherein said inner envelope is formed by a tubular sheet metal element.

3. A device according claim 1, wherein said inner envelope has a wall thickness in the area of 0.1 to 1 mm.

4. A device according to claim 3, wherein said wall thickness is 0.3 mm.

5. A device according to claim 1, wherein said inner envelope consists of molybdenum.

6. A device according to claim 1, wherein said inner envelope consists of tantalum.

7. A device according to claim 1, wherein said outer second envelope has a wall thickness in the range of 5 to 10 mm.

8. A device according to claim 1, wherein said outer envelope consists of steel.

9. A device according to claim 1, wherein said outer envelope consists of TiAl6V4.

10. A device according to claim 1, wherein said blank includes a plurality of webs projecting from the surface of said blank and forming spacers for said inner envelope surrounding said blank.

11. A device according to claim 1, wherein said outer envelope includes a plurality of webs projecting therefrom inwardly toward said inner envelope and forming spacers providing for a space between said inner and said outer envelopes.

12. A device according claim 1, wherein third and fourth envelopes are provided which are arranged between said first and said second envelopes in closely spaced relationship from themselves and said first and second envelopes, respectively.

13. A device according to claim 11, wherein said third envelope, which is disposed in closely spaced relationship adjacent said first envelope, includes a plurality of webs directed at one side toward said first envelope and, at the other side, toward said fourth envelope and serving as spacers between said third and said first and, respectively, said third and said fourth envelopes.

14. A device according to claim 12, wherein said third envelope consists of the same material as said second envelope.

15. A device according to claim 12, wherein said fourth envelope consists of the same material as said first envelope.

16. A device according to claim 1, wherein at least said outer envelope encloses said blank in a vacuum tight manner.

* * * * *

UNITED STATES PATENT AND TRADEMARK OFFICE

CERTIFICATE OF CORRECTION

PATENT NO. : 6,420,051 B1
DATED : July 16, 2002
INVENTOR(S) : Appel et al.

It is certified that error appears in the above-identified patent and that said Letters Patent is hereby corrected as shown below:

Title page,
Item [73], should read -- Geesthacht --

Signed and Sealed this

Twenty-seventh Day of May, 2003

JAMES E. ROGAN
*Director of the United States Patent and Trademark Office*